US008057640B2

(12) United States Patent
Annamalai et al.

(10) Patent No.: US 8,057,640 B2
(45) Date of Patent: Nov. 15, 2011

(54) DEASPHALTING TAR USING STRIPPING TOWER

(75) Inventors: Subramanian Annamalai, Houston, TX (US); James N McCoy, Houston, TX (US); Paul F Keusenkothen, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 170 days.

(21) Appl. No.: 12/482,148

(22) Filed: Jun. 10, 2009

(65) Prior Publication Data

US 2009/0242378 A1 Oct. 1, 2009

Related U.S. Application Data

(62) Division of application No. 11/589,454, filed on Oct. 30, 2006, now Pat. No. 7,560,020.

(51) Int. Cl.
*B01D 11/00* (2006.01)
*C10C 1/18* (2006.01)

(52) U.S. Cl. ..... 196/14.52; 422/609; 196/98

(58) Field of Classification Search ..... 196/14.52, 196/98; 202/96; 208/86, 309; 422/609
See application file for complete search history.

(56) References Cited

U.S. PATENT DOCUMENTS

| | | | | |
|---|---|---|---|---|
| 3,998,726 | A * | 12/1976 | Bunas et al. | 208/309 |
| 4,673,485 | A * | 6/1987 | Bristow et al. | 208/86 |
| 4,961,839 | A | 10/1990 | Stine et al. | |
| 5,089,114 | A * | 2/1992 | Tovar et al. | 208/50 |
| 5,944,984 | A * | 8/1999 | Benguigui et al. | 208/309 |
| 6,303,842 | B1 * | 10/2001 | Bridges et al. | 585/648 |
| 6,420,621 | B2 * | 7/2002 | Sha et al. | 585/653 |
| 6,533,925 | B1 | 3/2003 | Wallace et al. | |
| 7,431,803 | B2 * | 10/2008 | Stell | 196/98 |
| 7,488,459 | B2 * | 2/2009 | Stell et al. | 422/198 |
| 7,560,020 | B2 * | 7/2009 | Annamalai et al. | 208/86 |
| 7,744,743 | B2 * | 6/2010 | McCoy et al. | 208/86 |
| 7,846,324 | B2 * | 12/2010 | Annamalai et al. | 208/86 |
| 2004/0004022 | A1 | 1/2004 | Stell et al. | |
| 2005/0261530 | A1 | 11/2005 | Stell et al. | |
| 2007/0278328 | A1 | 12/2007 | Bartolini et al. | |
| 2008/0053869 | A1 | 3/2008 | McCoy et al. | |
| 2008/0083649 | A1 | 4/2008 | McCoy et al. | |
| 2008/0116109 | A1 | 5/2008 | McCoy et al. | |
| 2009/0238735 | A1 | 9/2009 | McCoy et al. | |
| 2009/0280042 | A1 | 11/2009 | McCoy et al. | |

FOREIGN PATENT DOCUMENTS

| | | |
|---|---|---|
| EP | 0250136 | 2/1992 |
| GB | 1298098 | 9/1973 |
| WO | 93/12200 | 6/1993 |

* cited by examiner

*Primary Examiner* — Nina Bhat

(57) ABSTRACT

Tar is contacted with stripping agent, such as steam or tail gas, in a stripping tower. A product comprising deasphalted tar is recovered as overheads and a product comprising heavy tar is recovered as bottoms from the stripping tower.

7 Claims, 2 Drawing Sheets

DEASPHALTING TAR USING STRIPPING TOWER

CROSS-REFERENCE TO RELATED APPLICATIONS

This application is a divisional of U.S. application Ser. No. 11/589,454, filed Oct. 30, 2006, now U.S. Pat. No. 7,560,020, which is hereby incorporated by reference.

FIELD OF THE INVENTION

The invention relates to the recovery of deasphalted tar (pyrolysis fuel oil).

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace wherein the feedstock, typically comprising crude or a fraction thereof optionally desalted, is heated sufficiently to cause thermal decomposition of the larger molecules. Among the valuable and desirable products include light olefins such as ethylene, propylene, and butylenes. The pyrolysis process, however, also produces molecules that tend to combine to form high molecular weight materials known as steam cracked tar or steam cracker tar, hereinafter referred to as "SCT". These are among the least valuable products obtained from the effluent of a pyrolysis furnace. In general, feedstocks containing higher boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

In U.S. Pat. No. 4,446,002, the precipitation of sediment in unconverted residuum obtained from a virgin residuum conversion process is taught to be suppressed by blending the unconverted residuum with an effective amount of a virgin residuum having an asphaltene content of at least about 8 wt % of the virgin residuum at a temperature sufficient to maintain both residuum components at a viscosity of no greater than about 100 cSt (centistokes) during blending. Virgin residuum is the bottoms product of the atmospheric distillation of petroleum crude oil at temperatures of about 357 to 385° C.

In U.S. Pat. No. 5,443,715, steam cracked tar is upgraded by mixing with a "hydrogen donor", preferably hydrotreated steam cracked tar, at or downstream of quenching of the effluent of a gas oil steam cracker furnace. In this regard, see also U.S. Pat. Nos. 5,215,649; and 3,707,459; and WO 9117230.

U.S. Pat. No. 7,312,371 discloses a process for cracking a heavy hydrocarbon feedstock containing non-volatile components and/or coke precursors, wherein a stripping agent is added to the feedstock to form a blend which is thereafter separated into a vapor phase and a liquid phase by flashing in a flash/separation vessel, and subsequently cracking the vapor phase.

Other references of interest include U.S. Pat. Nos. 3,622,502; 3,691,058; 4,207,168; 4,264,334; WO 91/13951; DE 4308507; and JP 58-149991.

The present inventor has surprisingly discovered that processing tar through a stripping tower produces an upgraded, deasphalted tar that is compatible with refinery fuel oil pools

SUMMARY OF THE INVENTION

The invention is directed to a process for deasphalting tar by contacting the tar and a stripping agent in a stripping tower and recovering an overhead comprising deasphalted tar and a heavy tar bottoms product.

In embodiments, the stripping agent is selected from at least one of tail gas and steam.

In preferred embodiments, the deasphalted tar taken overhead is compatible in all proportions with refinery fuel oil pools.

In another preferred embodiment, the bottoms product of the stripping tower is used in POX and/or coker.

It is an object of the invention to provide a process for upgrading tar.

These and other objects, features, and advantages will become apparent as reference is made to the following detailed description, preferred embodiments, examples, and appended claims.

BRIEF DESCRIPTION OF THE DRAWINGS

In the accompanying drawings, like reference numerals are used to denote like parts throughout the several views.

DETAILED DESCRIPTION

Figure 1:
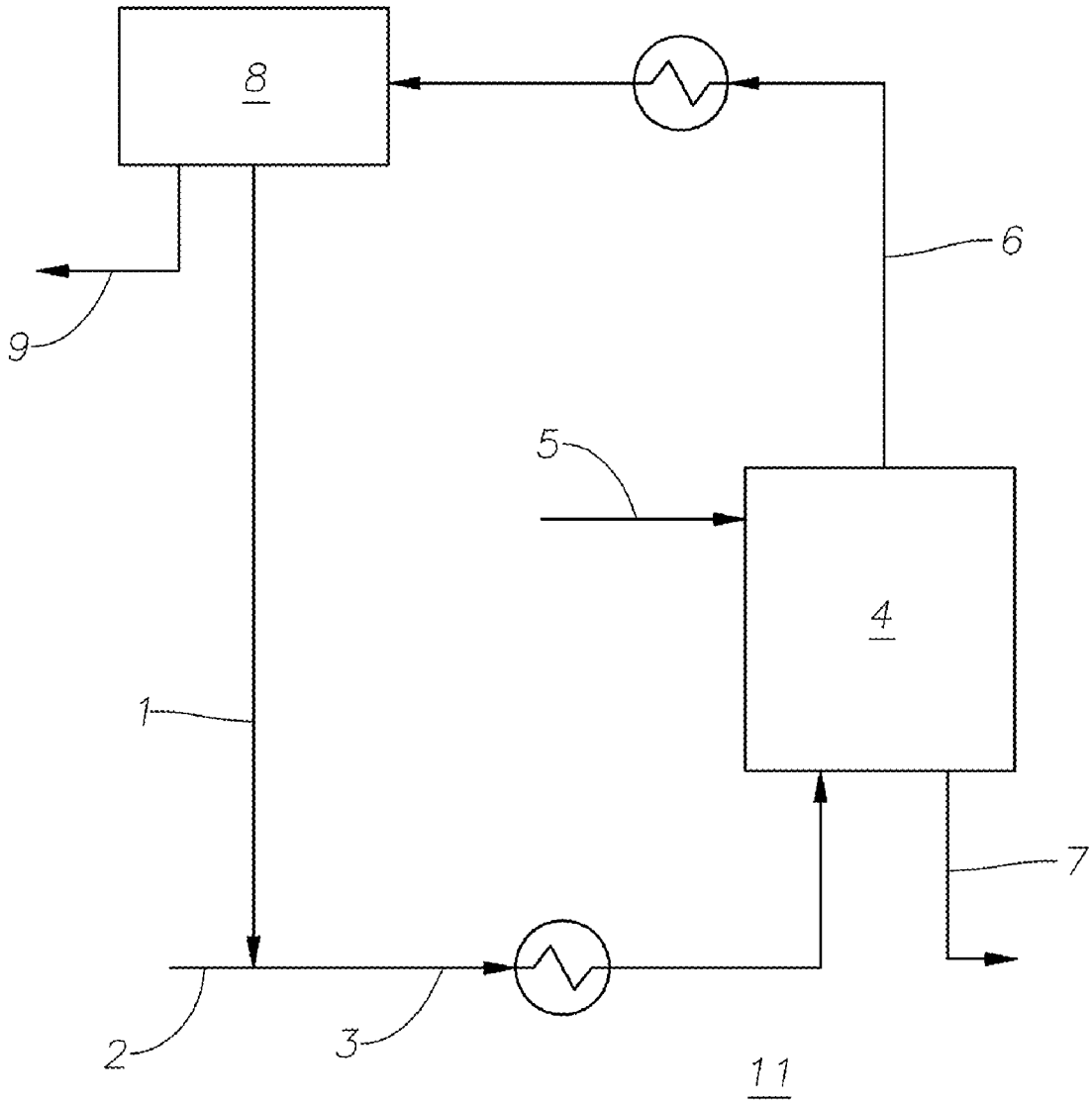
FIGS. 1 and 2 are process flow diagrams illustrating preferred embodiments of the present invention.

According to the invention, tar is contacted with stripping agent in a stripping tower. A product comprising deasphalted tar is recovered as overheads and a product comprising heavy tar is recovered as bottoms from the stripping tower.

"Tar" or steam cracker tar (SCT) as used herein is also referred to in the art as "pyrolysis fuel oil". The terms will be used interchangeably herein. The tar will typically be obtained from the first fractionator downstream from a steam cracker (pyrolysis furnace) as the bottoms product of the fractionator, nominally having a boiling point of 550° F.+ (288° C.+) and higher.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400 to 550° F., e.g., C10-C15/C17 species), and a bottoms fraction comprising SCT and having a boiling range above about 550° F., e.g., C15/C17+ species).

It should be noted that the terms thermal pyrolysis unit, pyrolysis unit, steam cracker and steam cracker are used synonymously herein; all refer to what is conventionally known as a steam cracker, even though steam is optional.

The term "asphaltene" is well-known in the art and generally refers to the material obtainable from crude oil and having an initial boiling point above 1200° F. (i.e., 1200° F.+ or 650° C.+ material) and which is insoluble in straight chain alkanes such as hexane and heptanes, i.e., paraffinic solvents. Asphaltenes are high molecular weight, complex aromatic ring structures and may exist as colloidal dispersions. They are soluble in aromatic solvents like xylene and toluene. Asphaltene content can be measured by various techniques known to those of skill in the art, e.g., ASTM D3279.

The tar is fed to the stripping tower where it is contacted with the stripping agent. The stripping tower may be a conventional stripping vessel or drum per se well-known in the refinery art. It may be a vapor/liquid separator, such as of the type described herein below. It may contain trays and/or comprise a packed column and/or contain stages. Numerous examples may be found in the prior art, such as, by way of example, WO2002031331. The specific design of the stripping tower is not per se a part of the present invention.

In a preferred embodiment the stripper tower operates at a temperature of between about 550° F. to about 1100° F. In this preferred embodiment, pressure may vary from about 10 psig to about 60 psig. Generally the higher the temperature the greater amount of volatiles are stripped from the tar and the lower the pressure the less amount of gas stripping agent is needed to strip the volatiles. Typically the amount of stripping gas by volume is 0.5 to 10 times the volume of tar contacted at a given stripper pressure and temperature, but the range varies widely. The details of operation, temperature, pressure, ratios of stripping agent to tar, setting of the flow-rates, and the like, is within the ability of one skilled in the art, given the benefit of this disclosure, without more than routine experimentation.

The stripping agent that contacts the tar is preferably selected from low molecular weight vapor hydrocarbon or a non-hydrocarbon stream such as $H_2$. Preferred stripping agents include methane, ethane, synthesis gas, coke-oven gas, refinery gas, acetylene tail gas, chill train tail gas, ethylene off-gas, steam, hydrogen gas, and mixtures thereof, more preferably steam and chill train tail gas. The tar feed is contacted in the stripper column, whereby volatiles are removed from the tar and entrain with the stripper gas overhead, with the non-volatile asphaltenic heavy tar recovered as bottoms in the stripper.

The volatiles, comprising deasphalted tar, are then separated from the stripping agent in a separate vessel, such as a settling drum. Typically, the separation may be conveniently accomplished by gravity, wherein cooled stripping agent, e.g., water, is taken as overflow from the settling drum and deasphalted tar fraction is taken as bottoms product. In another case where the stripping agent is a very low boiling material such as methane or $H_2$, the separation vessel may more conveniently be a vapor/liquid separator (sometimes referred to as flash pot or flash drum) such as disclosed and described in U.S. Patent Applications 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538; and U.S. Pat. No. 6,632,351.

Various embodiments of the present invention will now be illustrated by reference to the figures. It will be understood by those of skill in the art that these embodiments are intended only as illustrations and not intended to be limiting. Numerous variations will be immediately apparent to the skill artisan in possession of the present disclosure.

FIG. 1 is a simplified schematic flow diagram of a first embodiment of the invention, showing a system 11 useful in a process for deasphalting tar.

In the preferred embodiment shown in FIG. 1, the steam stripping is essentially kept in a closed loop. In this loop, process water in conduit 1 and any makeup water added through conduit 2 is vaporized and superheated by high pressure (HP) steam in a heat exchanger shown by the conventional heat exchange figure along conduit 3 to get hot enough (such as about 600° F.) to strip the tar in stripping tower 4, operated at, for instance, 30 psig. The stripping tower 4 in this preferred embodiment operates at low pressure, such as about 30 psig (±5 psig), and a temperature of about 850° F. (±25° F.). The feed comprising tar from the pyrolysis furnace primary fractionator (not shown) is added through conduit 5. With a preferred steam to tar ratio of from about 0.5:1 to about 1.5:1 by weight, such as about 1:1 by weight, the deasphalted tar goes overhead 6 with the steam and the 1000° F.+ product comprising asphaltenes removed as bottoms 7. The asphaltenic heavy tar product taken off in 7 may be sent to at least one of a POX unit or coker unit as described in more detail below, or burned locally in a furnace or boiler.

The overhead taken off through 6 is cooled, such as, in a preferred embodiment, to just below the water dew point, by another heat exchanger shown by conventional symbol along conduit 6 to allow the separation of process water from the deasphalted tar while maintaining enough gravity difference to avoid an emulsion in settler drum 8, operated at, for instance, about 25 psig. An emulsion breaker may be added if needed. The deasphalted tar, having a boiling point of from about 550° F. to about 1000° F., is taken as bottoms product 9 and process water is taken as overflow from drum 8 (although illustrated in the figure as exiting at the bottom, for convenience of view). The deasphalted tar product taken off in 9 may then be added in all proportions to fuel oil pool such as Bunker C fuel oil or lighter (lower density) fuel oil. It may be used alternatively, or in addition to mixing with fuel oil pools, as feed to a hydrocracker to produce diesel.

Figure 2:
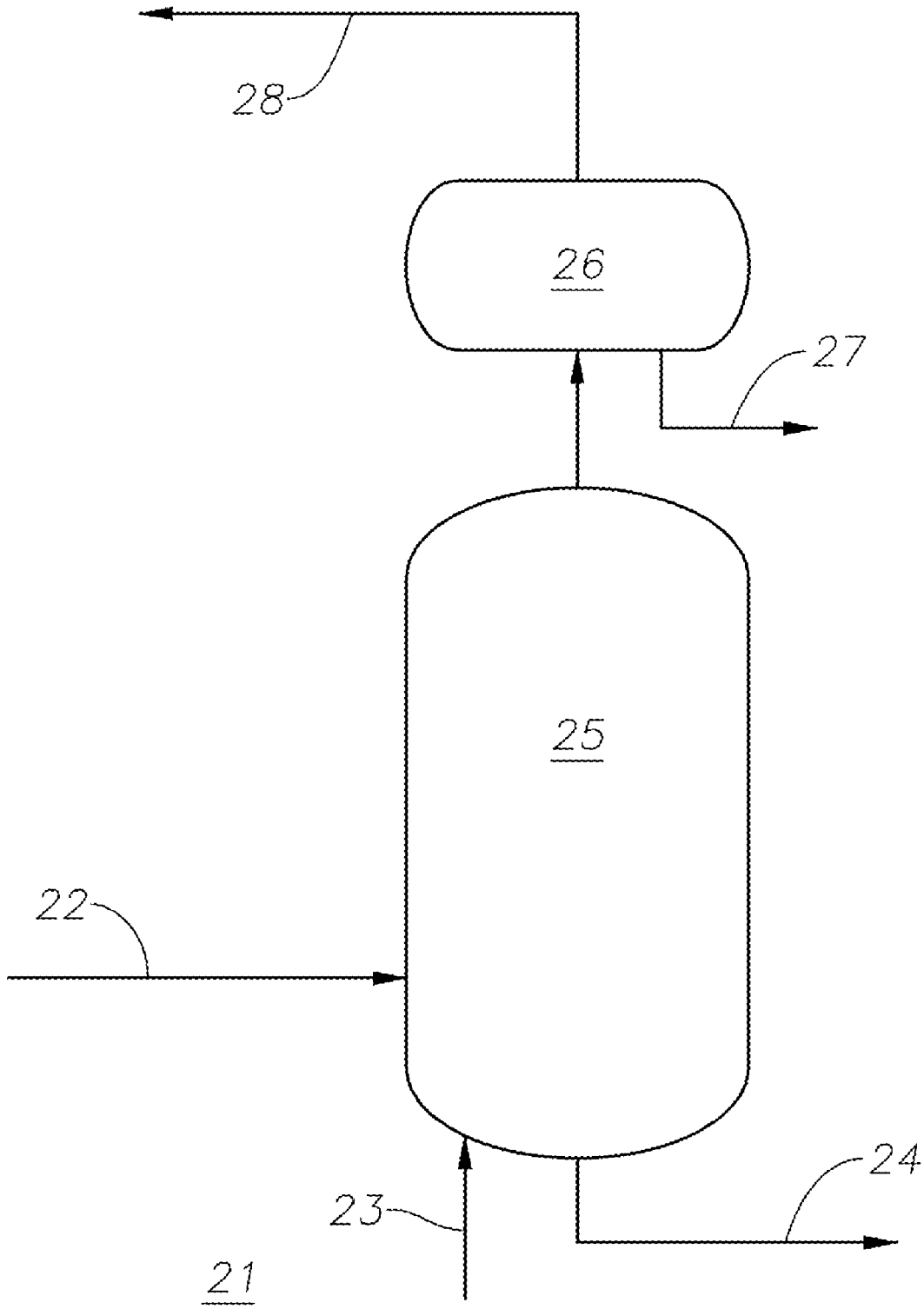

FIG. 2 is a simplified schematic flow diagram of a second embodiment of the invention, showing a system 21 useful in a process for deasphalting tar.

In the preferred embodiment shown in FIG. 2, tar is fed through conduit 22 into gas stripper 25, where it is contacted with high pressure (HP) tail gas through conduit 23 that is heated and depressurized from the chill train of a pyrolysis furnace (not shown). The gas: tar ratio is, in a preferred embodiment, about 1:1 by weight, typically ranging from 0.5:1 to about 1.5:1. Volatiles in the tar are stripped off and removed with the gas as overheads and the asphaltenic heavy tar fraction removed as bottoms product through conduit 24. The gas stripper operates, for instance, at a pressure of about 70-75 psia (typically about 55-60 psig) and temperature of about 860° F., measured at the overheads outlet. The overheads are flashed in a vapor liquid separator 26, such as is known per se in the art (or preferably a vapor liquid separator as described in the references discussed below with respect to vapor/liquid separators integrated with pyrolysis furnace), with the deasphalted tar taken as bottoms 27 in the vapor liquid separator and low pressure tail gas taken as overheads through conduit 28.

In the process according to the invention, such as in either of the specific embodiments discussed above, the yield of the deasphalted tar can be at least 50 wt %, preferably at least 60 wt %, more preferably at least 70 wt %, based on the weight of the tar entering the gas stripper.

In even more preferred embodiments the process of the invention, such as described by reference to systems 11 and 21, above, are integrated with refinery or chemical operations. Either system can be integrated readily with the primary fractionator from pyrolysis furnace so that the bottoms product of the furnace supplies the tar feed. System 11 can be integrated with refinery and/or chemical steam plants. In another embodiment, system 21 can be further integrated with a pyrolysis furnace so that the tail gas from the chill train is used as the stripping gas. The processes in systems 11 and 21 can be operated batch-wise, semi-batch-wise, or continuously.

In general the operating conditions of such a pyrolysis furnace, which may be a typical pyrolysis furnace such as known per se in the art, can be determined by one of ordinary skill in the art in possession of the present disclosure without more than routine experimentation. Typical conditions will include a radiant outlet temperature of between 760-880° C., a cracking residence time period of 0.01 to 1 sec, and a steam dilution of 0.2 to 4.0 kg steam per kg hydrocarbon.

It is preferred that the furnace have a vapor/liquid separation device (sometimes referred to as flash pot or flash drum) integrated therewith, such as disclosed and described in the aforementioned U.S. Patent Applications 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. In a preferred embodiment using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

The bottoms taken off in 7 of FIG. 1 and 24 in FIG. 2, comprising a heavy tar asphaltenic product having a boiling point of 1000° F.+ may be sent to at least one of a POX unit or coker unit.

The POX and coker units are not shown in the figures and are not considered part of the embodiments shown in systems 11 or 21 of FIGS. 1 and 2, respectively. However, one or both apparatus may be considered part of embodiments of the invention.

The term "POX" means a partial oxidation and POX unit as used herein refers to the apparatus within which the partial oxidation occurs. The term "coking" or "delayed coking" refers to a thermal cracking process by which a heavy material is converted into lighter material and coke, and the coking unit refers to the apparatus within which the coking occurs. Both process and apparatus terms are well known per se in refining.

In embodiments of the present invention, partial oxidation reacts the bottoms product from conduit 7 in FIG. 1 or 24 in FIG. 2 with oxygen at high temperatures to produce a mixture of hydrogen and carbon monoxide (Syn Gas). While the conditions of partial oxidation are not critical and can be determined by one of ordinary skill in the art, for the present invention preferred conditions include a temperature of about 1455° C. (±50° C.) and pressure of about 870 psig (±25 psig), measured at the reactor inlet. The $H_2$ and CO yields will vary according to conditions but in preferred embodiments will be in the range of about 0.98 to 1.8 $H_2$/CO, which may be achieved without undue experimentation by one of ordinary skill in the art in possession of the present disclosure. The Syn Gas is preferably used to make alcohols in integration with the well-known Oxo Process, or to make fuel, or to make a hydrogen rich product, or a combination of these uses.

In embodiments of the present invention, coking converts the hydrocarbon feed from the bottoms product in conduit 7 in FIG. 1 or 24 in FIG. 2 in the coker unit to coker naphtha and coker gas oil as overheads/sidestreams and coke as a bottoms product. In the present invention, the apparatus used may be a typical coker used in refinery processing, which in refining process converts residual oil from the crude unit vacuum or atmospheric column into gas oil. The process of coking or delayed coking is typically semi-continuous thermal cracking process which can be broken down to three distinct stages. The feed undergoes partial vaporization and mild cracking as it passes through the coking furnace. The vapours undergo cracking as they pass through the coke drum to fractionation facilities downstream. In a refinery the typical products of gas, naphtha, jet fuel and gas oil are separated in the fractionation facilities. According to the present invention, the products comprise coker naphtha and coker gas oil separated in the fractionation facilities; the petroleum coke remains in the drum. The heavy hydrocarbon liquid trapped in the coke drum is subjected to successive cracking and polymerization until it is converted to vapours and coke.

While appropriate coker conditions may be determined without undue experimentation by one of ordinary skill in the art in possession of the present disclosure, preferred conditions include a temperature of about 450 to 550° C. and pressure of about 15-25 psig, measured at the reactor inlet. Coke resulting from a low sulfur feed may be used for needle coke or anode coke. More generally, the coke produced by the process of the invention may be used for fuel.

The invention has been described above with reference to numerous embodiments and specific examples. Many variations will suggest themselves to those skilled in this art in light of the above detailed description. All such obvious variations are within the full intended scope of the appended claims. Particularly preferred embodiments include: a process comprising:(a) feeding said tar to a stripping tower and contacting said tar with a stripping agent; (b) obtaining as products of said stripping tower an overhead product comprising deasphalted tar and a bottoms product comprising a asphaltenic heavy tar composition; further modified by at least one of the following: wherein the overhead product of step (b) is sent to a separating vessel wherein a fraction comprising deasphalted tar is separated from a fraction comprising said stripping agent, particularly preferred wherein said stripping agent is then recycled to step (a); wherein said stripping agent comprises methane, ethane, synthesis gas, coke-oven gas, refinery gas, acetylene tail gas, chill train tail gas, ethylene off-gas, steam, hydrogen gas, and mixtures thereof, particularly wherein the stripping agent is steam or a mixture of methane and ethane or tail gas; wherein at least a portion of said deasphalted tar fraction is mixed with a fuel oil pool selected from the group consisting of Bunker fuel oil and fuel oils lighter than Bunker fuel oil, or wherein at least a portion of said deasphalted tar fraction is burned in a boiler and/or furnace, or wherein at least a portion of said deasphalted tar fraction is provided as feed to a hydrocracker to make diesel, or a combination of such fates for the deasphalted tar fraction; wherein said deasphalted tar fraction is at least 50 wt %, preferably at least 60 wt %, more preferably at least 70 wt %, of the tar contacted in step (a); wherein at least a portion of said asphaltenic heavy tar product is processed in a POX unit to produce syn gas and/or a coker unit to produce coker naphtha and coker gas oil; wherein the stripping tower in step (d) operates at a temperature of between about 550° F. to about 1100° F. and a pressure of from about 10 psig to about 60 psig, and wherein the ratio of volume of stripping gas to volume of tar is in the range of about 0.5 to 10; wherein, prior to step (a), crude or a fraction thereof is feed to a pyrolysis furnace to produce a product comprising light olefins selected from the group consisting of ethylene, propylene, and butenes, and tar, said tar is then separated from said light olefins in a primary fractionating column downstream of said pyrolysis furnace, and then said tar is provided to step (a).

Another preferred embodiment is an integrated system comprising: (a) a pyrolysis furnace; (b) a fractionating column in fluid communication with said pyrolysis furnace (whereby the products of said pyrolysis furnace are separated); (c) a stripping tower in fluid communication with the bottoms of said fractionating column; (d) a separation vessel in fluid communication with said stripping tower; (e) and at least one of a POX unit and/or coker unit in fluid communication with said stripping tower.

The meanings of terms used herein shall take their ordinary meaning in the art; reference shall be taken, in particular, to Handbook of Petroleum Refining Processes, Third Edition, Robert A. Meyers, Editor, McGraw-Hill (2004). All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated. Trade names used herein are indicated by a ™ symbol or ® symbol, indicating that the names may be protected by certain trademark rights, e.g., they may be registered trademarks in various jurisdictions.

What is claimed is:

1. An integrated system comprising:

(a) a pyrolysis furnace;

(b) a fractionating column downstream of and in fluid communication with said pyrolysis furnace;

(c) a stripping tower in fluid communication with the bottoms of said fractionating column;

(d) a separation vessel in fluid communication with overheads from said stripping tower; and (e) at least one of a POX unit and/or coker unit in fluid communication with bottoms from said stripping tower.

2. The system of claim 1, further comprising a stripping agent stream in fluid communication with said stripping tower.

3. The system of claim 2, wherein said stripping agent stream is in fluid communication with said separation vessel.

4. The system of claim 1, wherein said separation vessel is in fluid communication with a fuel oil pool or a hydrocracker.

5. The system of claim 1, further comprising a heat exchanger to cool overheads from said stripping tower.

6. The system of claim 2, further comprising a heat exchanger to heat said stripping agent stream.

7. The system of claim 6, wherein said heat exchanger is heated with high pressure steam.

* * * * *